US009190702B2

(12) United States Patent
Rose et al.

(10) Patent No.: US 9,190,702 B2
(45) Date of Patent: Nov. 17, 2015

(54) GANGED CIRCULATOR DEVICE

(71) Applicant: ELECTRONICS RESEARCH, INC., Chandler, IN (US)

(72) Inventors: Robert W. Rose, Evansville, IN (US); Nicholas A. Paulin, Santa Claus, IN (US)

(73) Assignee: ELECTRONIC RESEARCH, INC., Chandler, IN (US)

( * ) Notice: Subject to any disclaimer, the term of this patent is extended or adjusted under 35 U.S.C. 154(b) by 213 days.

(21) Appl. No.: 13/862,366

(22) Filed: Apr. 12, 2013

(65) Prior Publication Data

US 2013/0271232 A1 Oct. 17, 2013

Related U.S. Application Data

(60) Provisional application No. 61/624,270, filed on Apr. 14, 2012.

(51) Int. Cl.
*H01P 1/38* (2006.01)
*H01P 5/16* (2006.01)

(52) U.S. Cl.
CPC ... *H01P 1/38* (2013.01); *H01P 5/16* (2013.01)

(58) Field of Classification Search
CPC ..... H01P 1/32; H01P 1/36; H01P 1/38; H01P 5/12; H01P 5/16
USPC ..... 333/1.1, 24.2
See application file for complete search history.

(56) References Cited

U.S. PATENT DOCUMENTS 4,309,666 A * 1/1982 Ito et al. ..... 330/286
2001/0030586 A1* 10/2001 Fries ..... 333/117

* cited by examiner

*Primary Examiner* — Stephen E Jones
(74) *Attorney, Agent, or Firm* — C. Richard Martin

(57) ABSTRACT

A ganged circulator device for isolating a transmitter and increasing the power level, isolation performance, and input VSWR performance of an IBOC combiner module is provided. The ganged circulator device includes an input power divider, a ganged circulator module, and an output power combiner. The input power divider includes a first input port, a second input port, and a plurality of output ports. The ganged circulator module includes a plurality of circulators and a plurality of load resistors. The module also includes input ports corresponding to and electrically connected to the plurality of output ports on the input power divider. The output power combiner includes a first output port, a second output port, and plurality of input ports corresponding to and electrically connected to a plurality of output ports of the ganged circulator module. An input signal is applied at the first input port of the input power divider, and an output signal is transmitted from the second output port of the power combiner. A first load resistor is electrically connected to the second input port of the power divider, and a second load resistor is connected to the first output port of the power combiner.

21 Claims, 6 Drawing Sheets

GANGED CIRCULATOR DEVICE

FIELD OF THE INVENTION

The present invention relates to devices that provide transmitter-to-transmitter isolation and isolation from a system, such as an antenna or group of stations operating in a multiplexed system through the use of parallel low power circulators. More specifically, the present invention relates to improved power handling, temperature stability, isolation performance, and input VSWR performance of a single circulator.

BACKGROUND OF THE INVENTION

The standard master antenna dual-input RF system is typically designed for use by multiple radio stations operating both digital and analog transmitters. The antenna is typically provided with two wide-band ports, one designated analog and the other digital for combining in the antenna. Each station is provided its own analog or analog and digital IBOC (in-band-on-channel) combiner module to restrict transmitter-to-transmitter interference.

In single antenna input configurations, the multiplexing of combiner modules leaves a port available for future station expansion. The broad band port is always terminated with a load resister and is assumed to be available for emergency use. High levels of RF voltage may be present at this port because of summed energy from other transmitter combiner modules and reflected power from a mismatched antenna. It should always be assumed that there will be energy present at the broad band port and that port access must be restricted.

Intermodulation products are unintended frequencies generated within an RF system that potentially cause interference to other operations. To prevent intermodulation products and protect against overloading a directly connected station transmitter, a band pass filter is generally required and used to isolate the transmitter. The filter input port is only suitable for a single station.

Isolating the port for ease of access and flexible frequency use is an expensive problem. Stray voltages present at the multiplexer broad band port can be diminished by installing a circulator.

A circulator is a unidirectional 3 port device which passes forward energy undiminished and unshifted in phase from its input to its output port while directing reflected and incoming signals at its output port to a connected resistive load at its third port. Circulators are very narrow band devices and do not have wide band frequency responses required for master antenna systems. This is important because a circulator has decreased performance at frequencies other than the operating frequency within the FM operating band. Spurious energy reflected back to the output of the circulator must be absorbed by the circulator load resister which can cause considerable heating. Circulators can easily become saturated by the high forward power from an analog or digital IBOC RF injected source and, along with the summed energy of reflected waves from the master antenna station participants, become unstable. The transmitter isolation gained from the use of the circulator must be maintained under all types of operating conditions otherwise intermodulation products may be created potentially causing additional problems.

When digital IBOC was introduced, a level of −20 dBc (0.01 of the analog signal) was expected to provide similar coverage to the existing analog operations; however, it has been necessary to increase the digital IBOC power levels up to −10 dBc (0.10 of the analog signal) to achieve satisfactory coverage. Digital transmitters have always been susceptible to poor isolation from analog transmitters. Poor isolation causes intermodulation products to be generated, exceeding FCC allowable emissions. In order to increase isolation between analog and digital transmitters, it is common to use a circulator on the output of the digital transmitter. The circulator provides two benefits to the broadcaster. The first is increased isolation from the analog transmitter, thus reducing the reflected power seen by the digital transmitter and extending its life. The second benefit is that the circulator provides an extra failsafe for the digital transmitter in the event of antenna failure. Failure can occur from a burn out or a lightning strike. During upsets, it is possible for excessive analog power to be coupled to a digital transmission line run, resulting in digital transmitter failure while the analog transmitter is unaffected. The circulator helps guard against this possibility.

Current digital power levels are well within the limits of the existing circulators; however, as −10 dBc applications are being implemented, many of the circulators are not rated for the power increase. When it is overpowered, the circulator may lose its ability to isolate ports and allow RF power a path to the digital transmitter instead of dissipating the power in its resistive reject load. The circulator may also fail if the resistive load is over powered and burns, thus allowing all reflected power to be directed back to the transmitter with only a small loss. In both cases, the analog transmitter is susceptible to digital power coupling into the analog transmission line, causing the analog transmitter to see excessive reflected power.

FIG. 1 demonstrates the performance of a single typical prior art circulator. The circulator is inherently broad band if a VSWR of 1.5:1 is specified as broad band; however, when that specification is tightened to a VSWR of 1.1:1 the circulator appears to be narrow banded. For purposes of illustration, this circulator is tuned for 101 MHz. At 101 MHz, VSWR and isolation traces reach a compromise for best performance.

Circulators are sensitive to environmental changes. Air conditioning in a room can affect performance significantly. Frequently, when first put into operation, it is necessary to "hot-tune" the circulator as it warms and drifts from its tuned frequency. This method usually takes several hours until the circulator's temperature stabilizes.

SUMMARY OF THE INVENTION

The present invention provides a ganged circulator device for increasing the circulator's power level, isolation performance, input VSWR performance, and frequency stability. Low power radio frequency circulators have been built for many years using lump constant technology. These types of circulators are small in size and tend to have broad operating characteristics with excellent electrical performance. With the digital broadcasting trend moving towards higher power levels, if used as isolators in analog and digital applications, circulators must handle greater current and voltage levels. With these higher ratings, circulator construction costs escalate. Size increases, but operating bandwidth is reduced. By ganging multiple low power circulators, the present invention provides an inexpensive solution for high power applications.

A circulator's size also plays a big role in its ability to deliver stable performance. To cope with the heat generated within a circulator from internal resistive loss, circulators are built large in weight and scale. Larger circulators tend to have narrow bandwidth capability. By using small low power circulators ganged together, the present invention overcomes the narrow bandwidth problem.

The limited capability of a single circulator can be significantly improved if several identical circulators are placed in parallel using a unique ganging approach of the present invention. The present invention stacks or gangs standard 1.5 kW and 10 kW rated circulators to produce a complete product line able to handle power ranging from 3.0 kW to 40 kW. Some proposed embodiments include:

1) 1.5 kW Model; stand alone circulator 2) 3 kW Model; two (2) 1.5 kW Circulators are ganged to form a constant impedance module 3) 6 kW Model; four (4) 1.5 kW Circulators are ganged to form a constant impedance module 4) 10 kW Model; stand alone Circulator 5) 20 kW Model; two (2) 10 kW circulators are ganged to form a constant impedance module 6) 40 kW Model; four (4) 10 kW circulators are ganged to form a constant impedance module.

The ganged circulator device of the present invention combines both constant impedance operation with high average power handling and high absorption capability. By distributing the applied RF power among parallel connected circulators, the device can tolerate high digital IBOC power levels without failure.

According to a general aspect of the present invention a ganged circulator device is provided having an input power divider, a ganged circulator module, and an output power combiner. The input power divider includes a first input port, a second input port, and a plurality of output ports. The ganged circulator module includes a plurality of circulators and a plurality of load resistors. The module also includes input ports corresponding to and electrically connected to the plurality of output ports on the input power divider. The output power combiner includes a first output port, a second output port, and plurality of input ports corresponding to and electrically connected to a plurality of output ports of the ganged circulator module. An input signal is applied at the first input port of the input power divider, and an output signal is transmitted from the second output port of the power combiner. A first load resistor is electrically connected to the second input port of the power divider, and a second load resistor is connected to the first output port of the power combiner.

According to a further aspect of the invention, the ganged circulator module discussed above comprises a plurality of circulators. Each one of the plurality of circulators includes an input port electrically connected to a corresponding one of the plurality of output ports of the input power divider. Each one of the plurality of circulators also includes an output port electrically connected to a corresponding one of the plurality of input ports of the power combiner.

According to a further aspect of the present invention shown in FIG. 2, the power divider comprises a first 90 degree quadrature input hybrid power divider. The plurality of output ports therein comprises a first output port and a second output. Similarly, the power combiner comprises a second 90 degree quadrature output hybrid power combiner. The plurality of input ports therein comprises a first input port and a second input port. The ganged circulator module according to this aspect of the invention includes a first circulator and a second circulator. The first circulator includes an input port electrically connected to the first output port of the input hybrid power divider and an output port electrically coupled to the first input port of the output hybrid power combiner. Similarly, the second circulator includes an input port electrically connected to the second output port of the input hybrid power divider and an output port electrically coupled to the second input port of the output hybrid power combiner. A 50 ohm load resistor, which acts as an isolator or reject load, preferably may be connected to a third port of each one of the plurality of circulators.

Yet a further aspect of the present invention, shown in FIG. 4, provides the power divider which comprises a first 90 degree quadrature input hybrid power divider. The plurality of output ports therein comprises a first output port and a second output. Similarly, the power combiner comprises a second 90 degree quadrature output hybrid power combiner. The plurality of input ports therein comprises a first input port and a second input port. The ganged circulator module according to this aspect of the invention comprises a first ganged circulator sub-module and a second ganged circulator sub-module. The first ganged circulator sub-module includes an input electrically connected to the first output port of the first 90 degree quadrature input hybrid power divider and an output electrically connected to the first input port of the second 90 degree quadrature output hybrid power combiner. Similarly, the second ganged circulator sub-module includes an input electrically connected to the second output port of the first 90 degree quadrature input hybrid power divider and an output electrically connected to the second input port of the second 90 degree quadrature output hybrid combiner. Each of the first and second ganged circulator sub-modules comprises a sub-module 90 degree quadrature input hybrid power divider, a plurality of circulators, an a sub-module 90 degree quadrature output hybrid power combiner. The sub-module 90 degree quadrature input hybrid power divider includes a first input port corresponding to the input of the sub-module, a second input port electrically connected to a load resistor, and a plurality of output ports. Each one of the plurality of circulators includes an input port electrically connected to a corresponding one of the plurality of output ports of the input power divider, and each one of the plurality of circulators further includes an output port. The sub-module 90 degree quadrature output hybrid power combiner includes a first output port electrically coupled to a load resistor, a second output port corresponding to the output of the sub-module, and plurality of input ports corresponding to and electrically connected to the plurality of output ports of the plurality of circulators. A load resistor, acting as an isolator or reject load, may be connected to a third port of each one of said plurality of circulators.

According to a further aspect of the present invention as shown in FIG. 8, the all quadrature input hybrid power dividers and all quadrature output hybrid power combiners are folded into a U-shape such that the plurality of circulators are in close proximity to one another and share magnetic fields. An adjustable magnetic shunting device having a plurality of legs may be interposed between each of the plurality of circulators for disrupting coupling between said circulators.

A further aspect of the present invention is shown in FIG. 6, wherein the input power divider comprises an input ladder circuit and the output power combiner comprises an output ladder circuit. According to this aspect of the invention, the ganged circulator module comprises a plurality of circulators. Preferably, four circulators are used. Each one of the plurality of circulators includes an input port electrically connected to a corresponding one of the plurality of output ports of the input ladder circuit. Each one of the plurality of circulators also includes an output port electrically connected to a corresponding one of the plurality of input ports of the output ladder circuit. A load resistor, which acts as an isolator or reject load, may be connected to a third port of each one of the plurality of circulators.

These and other objects, features and advantages of the present invention will become apparent with reference to the text and the drawings of this application.

DETAILED DESCRIPTION OF PREFERRED EMBODIMENTS

Figure 1:
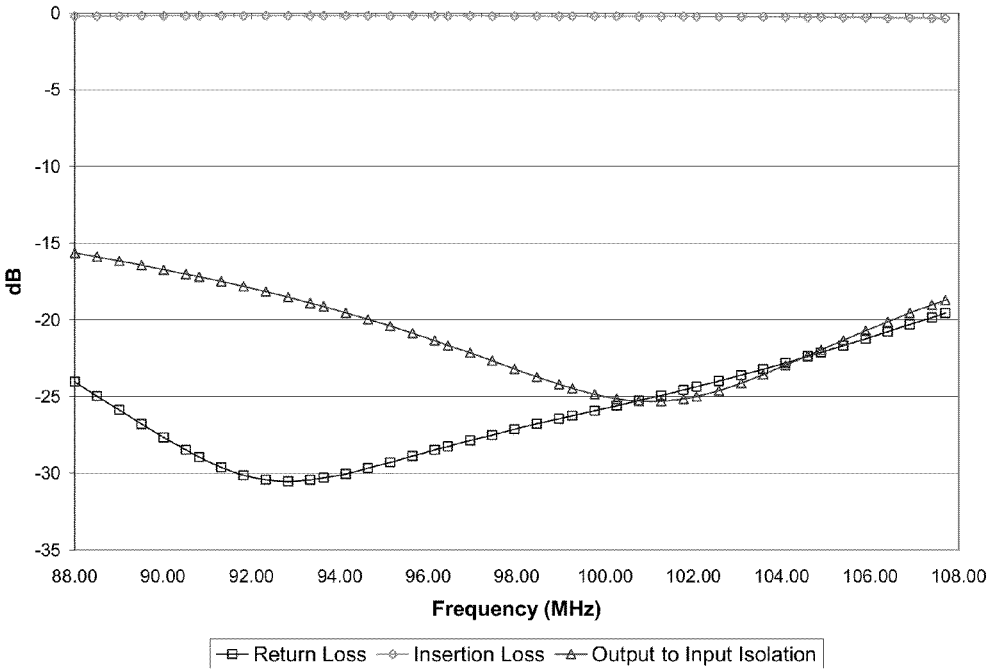
FIGURE 1 (PRIOR ART)
FIG. 1 is a graph demonstrating the performance of a typical circulator in use according to the prior art.

The present invention utilizes two or more existing circulators and distributes power among them in the form of a Ganged Circulator Device 10. According to the present invention, the Ganged Circulator Device 10 includes three basic components: an input power divider 12, a ganged circulator module 14, and an output power combiner 16. The input power divider 12 includes a first input port 12*a*, a second input port 12*b*, and a plurality of output ports, i.e. 12*c*, 12*d*. The ganged circulator module 14 includes a plurality of input ports corresponding to and electrically connected to the plurality of output ports on the input power divider 12. The output power combiner 16 includes a first output port 16*a*, a second output port 16*b*, and plurality of input ports 16*c*, 16*d* corresponding to and electrically connected to a plurality of output ports of the ganged circulator module 14. An input signal may be applied at the first input port 12*a* of the input power divider 12, and an output signal is transmitted from the second port 16*b* of the power combiner 16. A first reject load resistor 18 may be connected to the second input port 12*b* of the power divider 12, and a second reject load resistor 20 may be connected to the first output port 16*a* of the power combiner 16.

Figure 2:
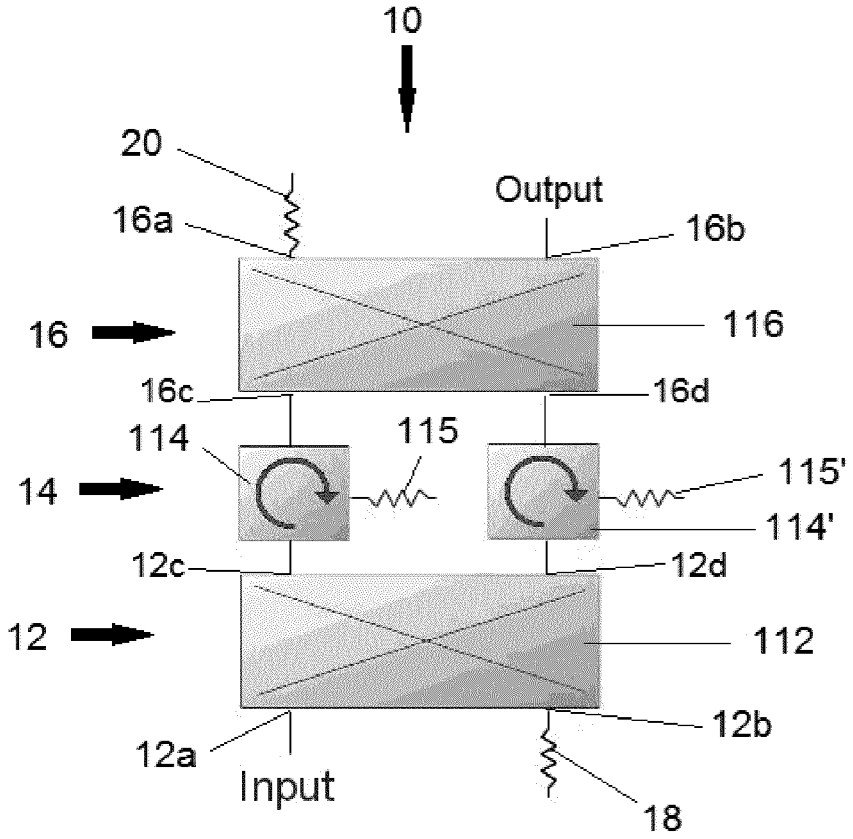
FIG. 2 is a schematic diagram of a two circulator ganged circulator device according to one presently preferred embodiment of the present invention.

According to a presently preferred first embodiment of the invention shown in FIG. 2, two circulators 114, 114' are connected together through a 90 degree quadrature hybrid power divider 112 on the input side and a second 90 degree quadrature hybrid power combiner 116 connected to the output ports of the two circulators 114, 114'. The input hybrid splits the power equally to each circulator and increase power handling by a factor of two.

Figure 3:
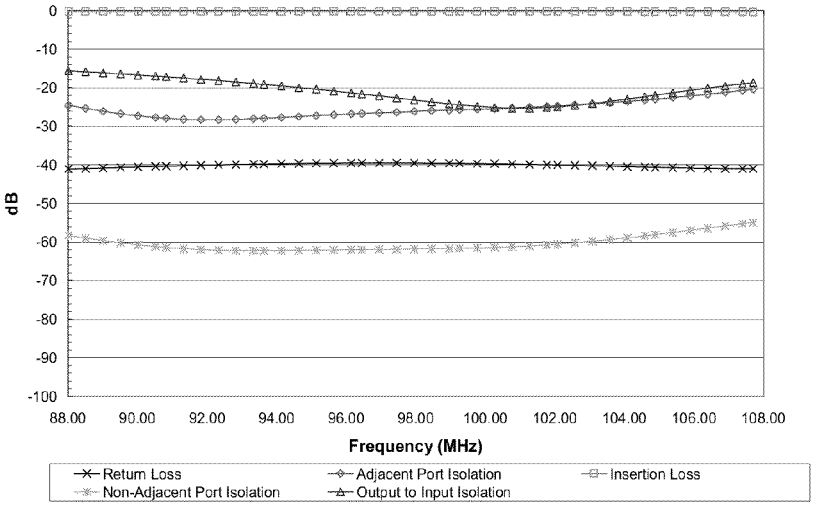
FIG. 3 is a graph demonstrating the performance of the ganged circulator device shown in FIG. 2.

The benefits of this approach are resistance to circulator drift and constant port impedances with respect to temperature. As the circulators heat and drift from the tuned frequency, any reflected power not directed to the circulator resistive loads 115, 115' connected to the circulators is diverted to either of the isolated load ports attached to the hybrids. The VSWR of the system following the transmitter will remain satisfactory regardless of power input over a large temperature range when compared to a single circulator. Isolation remains virtually unchanged while insertion loss degrades by approximately −0.05 dB. A detailed graph of performance is presented in FIG. 3.

The circulators 114, 114' used in the ganged circuit are three-port devices having the inherent ability to direct power entering any one port to the next port in rotation with a low insertion loss. When one port of the three-port circulator is terminated in a precision 50Ω resistor, it can become an isolator, since a signal can travel in only one direction between the remaining ports. With circulators 114, 114' positioned between the two hybrid couplers 112, 116, as shown in FIG. 2, the ganged devices' outgoing signals are passive, routed to one of two outputs ports feeding respective antennas. However, reflected signals from the antenna or antennas are decoupled from their respective transmitters attached through the input circulator input ports by the one-way directionality of the circulators. This reflected energy is dissipated in the circulators resistors 115, 115'.

Figure 4:
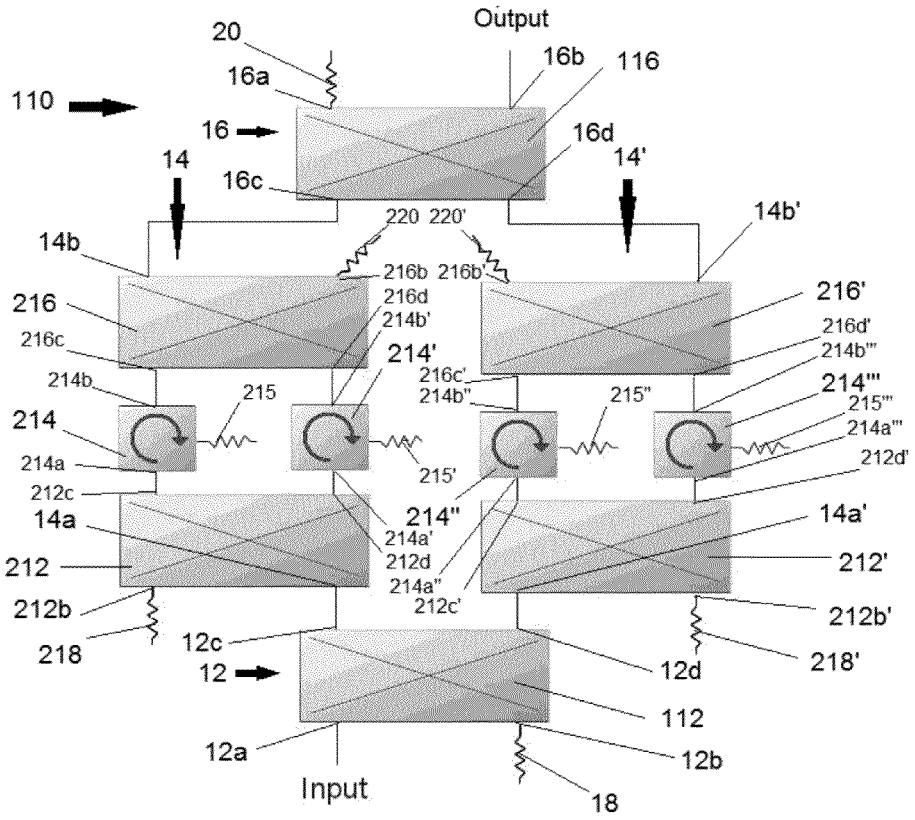
FIG. 4 is a schematic diagram of a four circulator ganged circulator device according to one presently preferred embodiment of the present invention.

An alternative embodiment designed to handle higher power levels is shown in FIG. 4. Similar to the embodiment shown in FIG. 2, the Ganged Circulator 110 shown in FIG. 4 includes a first 90 degree quadrature input hybrid power divider 112 on the input side and a second 90 degree quadrature output hybrid power combiner 116 on the output side. The ganged circulator module positioned between includes a first ganged circulator sub-module 14 and a second identical ganged circulator sub-module 14'. Each ganged circulator sub-module 14, 14' includes an input 14*a*, 14*a'* electrically connected to the first output port 12*c* and second output port 12*d*, respectively, of the first 90 degree quadrature input hybrid power divider 112, and an output 14*b*, 14*b'* electrically connected to the first input port 16*c* and second input port 16*d*, respectively, of the second 90 degree quadrature output hybrid power combiner 116.

Each of the first and second ganged circulator sub-modules 14, 14' shown in FIG. 4 is essentially the same as the single ganged circulator device 10 shown in FIG. 2. Each sub-module 14, 14' includes an input power divider 212, 212' having a first input port corresponding to the input port 14*a*, 14*a'* of the sub-module 14, 14'. A second input port 212*b*, 212*b'* is electrically connected to a load resistor 218, 218'. Each of the input power dividers 212, 212' also includes first and second output ports 212*c*, 212*c'*, 212*d*, 212*d'*, respectively. First and second circulators 214, 214', 214", 214'" are associated with each respective sub-module 14, 14'. Each circulator 214, 214', 214", 214'" has an input port 214*a*, 214*a'*, 214*a"*, 214*a'"* electrically connected to a corresponding one of the output ports 212*c*, 212*d*, 212*c'*, 212*d'*, respectively, of the input power divider 212. Each circulator 214, 214', 214", 214'" also has an output port 214*b*, 214*b'*, 214*b"*, 214*b'"*, which is electrically connected to a corresponding input port 216*c*, 216*d*, 216*c'*, 216*d'* on one of the corresponding output power combiners 216, 216'. Each output power combiner 216, 216' includes an output port corresponding to the sub-module output ports 14*b*, 14*b'* that is electrically coupled to respective first and second input ports 16*c*, 16*d* of the second 90 degree quadrature output hybrid coupler 116. Each of the respective second output ports 216*b*, 216*b'* of the output power combiner 216 is connected to a corresponding load resistor 220, 220'.

Each of the first and second ganged circulator sub-modules 14, 14' shown in FIG. 4 further includes a load resistor 215, 215', 215", 215'" connected to a third port of each one of the respective circulators 214, 214', 214", 214'". Each load resistor 215, 215', 215", 215'" acts as an isolator or reject load, and preferably is a precision 50 ohm resistor.

Figure 5:
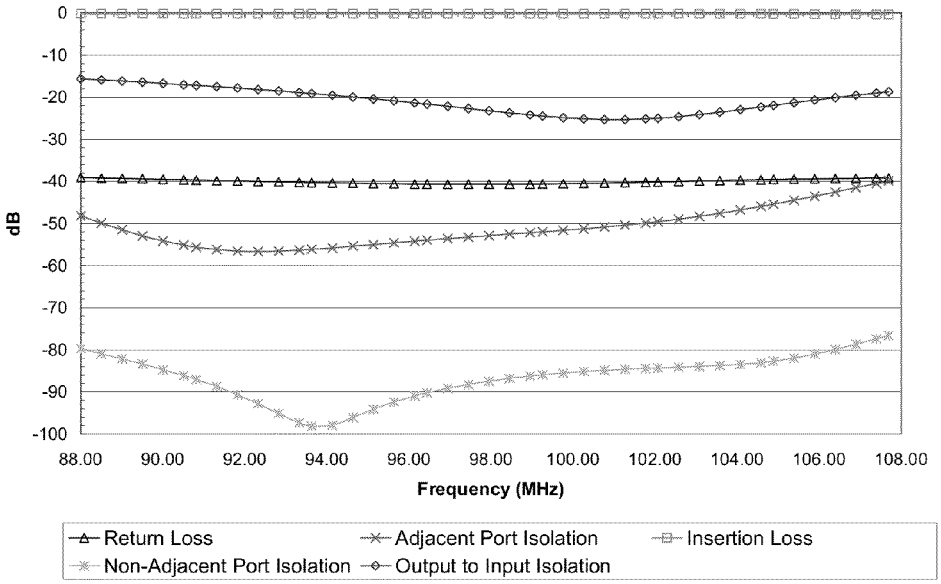
FIG. 5 is a graph demonstrating the performance of the ganged circulator device shown in FIG. 4.

The circuit shown in FIG. 4 has two (2) times higher power handling capacity as compared to the circuit shown in FIG. 2, and improved isolation to the terminated ports of the circuit. A detailed description of performance is presented in FIG. 5.

Figure 6:
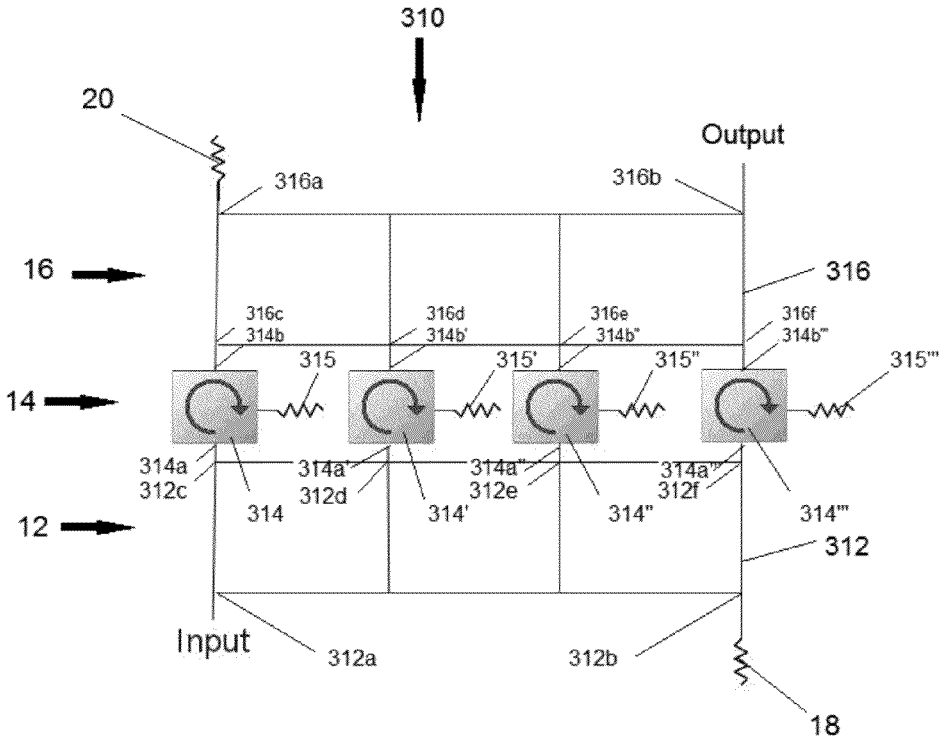
FIG. 6 is a schematic diagram of a four circulator ganged circulator device according to an alternative presently preferred embodiment of the present invention.

According to yet another embodiment of the present invention shown in FIG. 6, a ladder hybrid ganged circulator 310 can also be used to achieve the same higher power handling results as the 90 degree hybrid network as depicted in FIG. 4. According to this embodiment, the input power divider 12 comprises an input ladder circuit 312 having a total of six (6) ports, including first and second input ports 312*a*, 312*b*, and four (4) output ports 312*c*, 312*d*, 312*e*, 312*f*, each having a different phase shift (0 degrees for 312*c*, −90 degrees for 312*d*, −180 degrees for 312*e*, −270 degrees for 312*f*) because of the different physical/electrical length of each leg. Similarly, the output power combiner 16 comprises an output ladder circuit 316 having first and second output ports 316*a*, 316*b*, and four (4) input ports 316*c*, 316*d*, 316*e*, 316*f*. The ganged circulator module 14, according to the embodiment shown in FIG. 6 includes four (4) circulators, 314, 314', 314", 314'". Each of the circulators 314, 314', 314", 314'" includes a respective input port 314*a*, 314*a'*, 314*a"*, 314*a'"* electrically connected to a corresponding output port 312*c*, 312*d*, 312*e*, 312*f* of the input ladder circuit 312. Each of the circulators 314, 314', 314", 314'" also includes a respective output port 314*b*, 314*b'*, 314*b"*, 314*b'"* electrically connected to a corresponding input port 316*c*, 316*d*, 316*e*, 316*f* of the output ladder circuit 316.

Each of the circulators 314, 314', 314", 314'" also includes a respective load resistor 315, 315', 315", 315'"connected to a third port of each respective circulator 314, 314', 314", 314'". Each load resistor 315, 315', 315", 315'" acts as an isolator or reject load, and preferably is a precision 50 ohm resistor.

This approach allows the circuit to gain a power handling advantage by a factor of four compared to a single circulator. For the ladder hybrid ganged circulator 310 according to the embodiment shown in FIG. 6, the input VSWR, isolation, and insertion losses all maintain the same advantages of the ganged circulator 10 of the first embodiment shown in FIG. 2 and the ganged circulator 110 of the second embodiment shown in FIG. 4.

Preferably, each one of the input ladder circuit 312 and output ladder circuit 316 is a 6-port bridge network circuit constructed from ten (10) 50 Ohm coaxial line or stripline sections cut ¼ wavelength at the network's design frequency, resulting in the circuit having a practical operating bandwidth of approximately 10 MHz. By tapping the corners of the input ladder circuit 312 as shown in FIG. 6, the first and second input ports 312*a*, 312*b*, and output ports 312*c*-312*f* are formed. The same basic ladder circuit configuration is used to build the output ladder circuit 316 shown in FIG. 6, except that the output ladder circuit 316 has two output ports 316*a*, 316*b*, and four input ports, 316*c*-316*f*.

By interconnecting the output ports 312*c*-312*f* of the input ladder circuit 312 to a second identical output ladder circuit 316, the second, output ladder circuit 316 behaves as if it were a power combining device taking the low voltage output signals from the first input ladder circuit 312 and, through vector summation, recombines at the output port 316*b*. Illustrated in an equivalent circuit shown in FIG. 6, is the second output ladder circuit 316 along with four reverse signal blocking circulators 315, 315', 315", 315'". As shown in FIG. 6, the second input port 312*b* and first output port 316*a* have been terminated into precision 50Ω resistors 18, 20 respectively, and absorb the energy reflected by the circulators 115, 115', 115", 115'".

Figure 7:
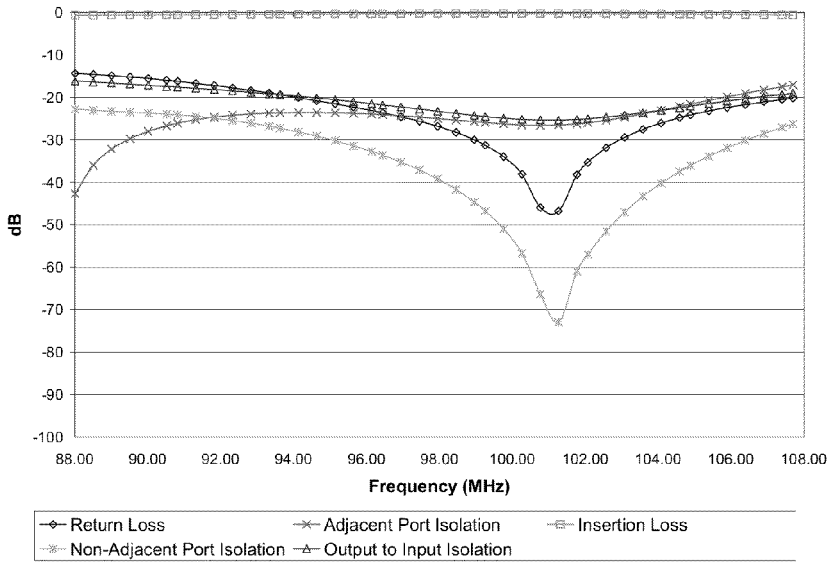
FIG. 7 is a graph demonstrating the performance of the ganged circulator device shown in FIG. 6.

Each of the 2-ganged and 4-ganged devices has advantages to a single circulator. Due to resistive heating, a circulator can become quite unstable if high power is applied. Ancillary cooling equipment may be needed to cool the circulator. More stable high power performance can be achieved by connecting multiple circulators in parallel, as illustrated in FIGS. 2, 4 & 6. Parallel circulator devices provide constant impedance and broad-band input port impedances centered within the FM band. A more detailed accounting of performance can be seen in FIG. 7.

Figure 8:
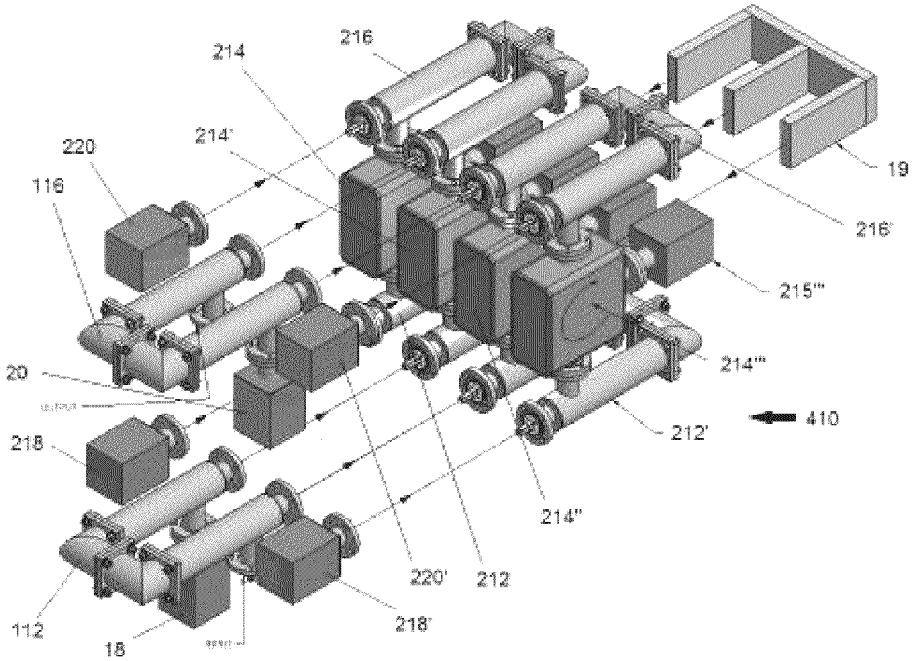
FIG. 8 is an exploded drawing in perspective of a four circulator ganged circulator device as diagrammed in FIG. 4, shown here with U-shaped hybrid couplers.

An alternative method of connecting the four circulators 214, 214', 214", 214'" to make a high power constant impedance ganged unit 410 according to yet another embodiment of the present invention is shown in FIG. 8. By bending or folding a hybrid coupler into a "U" shape and interconnecting three input hybrid power dividers 112, 212, 212' and three output hybrid power combiners 116, 216, 216' with four circulators 214, 214', 214", 214'", a compact ganged Circulator 410 is formed. Other than the U-shaped nature of the hybrid couplers 112, 212, 212', 216, 216', 116, the components of the compact ganged circulator 410 correspond to the components of the ganged circulator 110 shown in FIG. 4. An advantage to this arrangement is that the shared magnetic field between circulators 214, 214', 214", 214'" is combined improving its temperature stability. A common adjustable magnetic shunting device 19 improves the performance of the hybrid power dividers, hybrid power combiners, and circulators. The comb-like magnetic shunt 19 disrupts the coupling between circulators 214, 214', 214", 214'", fine tuning the unit for optimum performance.

According to the preferred embodiments described above, a 1.5 kW circulator was used as the basic building block with power ratings from 3 kW for a two circulator device to 6 kW for a four circulator device. The VSWR performance and transmitter isolation are improved over a single circulator.

Using circulators to protect transmitters from high levels of coupled power within antenna combined systems is becoming more common. Traditionally, circulators have only been placed on the outputs of digital transmitters; but with digital power increases, more caution is needed to ensure the analog transmitter is protected as well. The present invention will allow the combining of low power circulator designs to create a device that is capable of two to four times the normal power handling. If four 10 kW circulators, for example, are chosen to construct a four-circulator device, it will have a 40 kW power handling capacity and be capable of protecting most analog transmitters. The stability of the new proposed devices eliminates the need to hot tune circulators while in operation.

The foregoing is provided for purposes of illustrating, explaining, and describing embodiments of the present invention. The specific components and order of the steps listed above, while preferred is not necessarily required. Further modifications and adaptation to these embodiments will be apparent to those skilled in the art and may be made without departing from the scope or spirit of the invention.

The invention claimed is:

1. A ganged circulator device comprising:

an input power divider having a first input port for receiving an input signal, a second input port, and a plurality of output ports;

a ganged circulator module comprising a plurality of circulators, each one of said plurality of circulators having an input port electrically connected to a corresponding one of said plurality of output ports of said input power divider; and an output power combiner having a first output port, a second output port for transmitting an output signal, and plurality of input ports corresponding to and electrically connected to a corresponding output port on each one of said plurality of circulators;

wherein each of said input power divider and said output power combiner are folded into a U-shape such that said plurality of circulators are in close proximity to one another and share magnetic fields.

2. The ganged circulator device according to claim 1, further comprising an adjustable magnetic shunting device having a plurality of legs interposed between each of said plurality of circulators for disrupting coupling between said circulators.

3. The ganged circulator device according to claim 1, wherein a first load resistor is electrically connected to the second input port of the power divider, and a second load resistor is connected to the first output port of the power combiner.

4. The ganged circulator device according to claim 2, wherein the power divider comprises a first 90 degree quadrature input hybrid power divider, and said plurality of output ports comprise a first output port and a second output; and the power combiner comprises a second 90 degree quadrature output hybrid power combiner, and said plurality of input ports comprise a first input port and a second input port.

5. The ganged circulator device according to claim 4, wherein the ganged circulator module comprises:

a first circulator having an input port electrically connected to said first output port of said input hybrid power divider and an output port electrically coupled to said first input port of said output hybrid power combiner; and a second circulator having an input port electrically connected to said second output port of said input hybrid power divider and an output port electrically coupled to said second input port of said output hybrid power combiner.

6. The ganged circulator device according to claim 5, further comprising a load resistor connected to a third port of each one of said plurality of circulators.

7. The ganged circulator device according to claim 6, wherein each load resistor acts as an isolator.

8. The ganged circulator device according to claim 7, wherein each load resistor comprises a precision 50 ohm resistor.

9. The ganged circulator device according to claim 8, wherein the ganged circulator module comprises:

a first ganged circulator sub-module having an input electrically connected to said first output port of the first 90 degree quadrature input hybrid power divider and an output electrically connected to said first input port of the second 90 degree quadrature output hybrid power combiner; and a second ganged circulator sub-module having an input electrically connected to said second output port of the first 90 degree quadrature input hybrid power divider and an output electrically connected to said second input port of the second 90 degree quadrature output hybrid combiner.

10. The ganged circulator device according to claim 3, wherein the input power divider comprises an input ladder circuit and the output power combiner comprises an output ladder circuit.

11. The ganged circulator device according to claim 10, wherein said input ladder circuit is comprised of a plurality of frequency specific lengths of transmission line interconnecting said first and second input ports and said plurality of output ports, and said output ladder circuit is comprised of a plurality of frequency specific lengths of transmission line interconnecting said first and second output ports and said plurality of input ports.

12. The ganged circulator device according to claim 11, wherein the frequency specific lengths of transmission line are selected from a group consisting of rigid coaxial cable, coaxial cable, strip line conductors, and printed circuits.

13. The ganged circulator device according to claim 10, wherein the ganged circulator module comprises a plurality of circulators, each one of said plurality of circulators having an input port electrically connected to a corresponding one of said plurality of output ports of said input ladder circuit, and each one of said plurality of circulators having an output port electrically connected to a corresponding one of said plurality of input ports of said output ladder circuit.

14. The ganged circulator device according to claim 13, wherein the plurality of circulators comprises four circulators.

15. The ganged circulator device according to claim 13, further comprising a load resistor connected to a third port of each one of said plurality of circulators.

16. The ganged circulator device according to claim 15, wherein each load resistor acts as an isolator.

17. A ganged circulator device comprising:

an input power divider having a first input port for receiving an input signal, a second input port, a first output port and a second output port;

a first ganged circulator sub-module having an input electrically connected to said first output port of the input power divider;

a second ganged circulator sub-module having an input electrically connected to said second output port of the input power divider; and an output power combiner having a first output port, a second output port for transmitting an output signal, a first input port electrically connected to an output port of the first ganged circulator sub-module, and a second input port electrically connected to an output port of the second ganged circulator sub-module;

wherein each of the first and second ganged circulator sub-modules comprises:

a sub-module 90 degree quadrature input hybrid power divider having a first input port corresponding to the input of the sub-module, a second input port electrically connected to a load resistor, and a plurality of output ports;

a plurality of circulators, each one of said plurality of circulators having an input port electrically connected to a corresponding one of said plurality of output ports of said input power divider, and each one of said plurality of circulators further having an output port; and a sub-module 90 degree quadrature output hybrid power combiner having a first output port electrically coupled to a load resistor, a second output port corresponding to the output of the sub-module, and plurality of input ports corresponding to and electrically connected to said plurality of output ports of said plurality of circulators.

18. The ganged circulator device according to claim 17, further comprising a load resistor connected to a third port of each one of said plurality of circulators.

19. The ganged circulator device according to claim 18, wherein each load resistor acts as an isolator.

20. The ganged circulator device according to claim 17, wherein each of said first 90 degree quadrature input hybrid power divider, said second 90 degree quadrature output hybrid power combiner, said first ganged circulator sub-module 90 degree quadrature input hybrid power divider, said second ganged circulator sub-module 90 degree quadrature input hybrid power divider, said first ganged circulator sub-module 90 degree quadrature output hybrid power combiner, and said second ganged circulator sub-module 90 degree quadrature output hybrid power combiner are folded into a U-shape such that said plurality of circulators are in close proximity to one another and share magnetic fields.

21. The ganged circulator device according to claim 20, further comprising an adjustable magnetic shunting device having a plurality of legs interposed between each of said plurality of circulators for disrupting coupling between said circulators.

* * * * *